United States Patent [19]

Ullrich

[11] 4,154,584

[45] May 15, 1979

[54] METHOD FOR COOLING GASES CONTAINING NAPHTHALENE, TAR AND SOLIDS

[75] Inventor: Hansjürgen Ullrich, Bochum, Fed. Rep. of Germany

[73] Assignee: Dr. C. Otto & Comp. G.m.b.H., Bochum, Fed. Rep. of Germany

[21] Appl. No.: 815,884

[22] Filed: Jul. 15, 1977

[30] Foreign Application Priority Data

Jul. 16, 1976 [DE] Fed. Rep. of Germany ..... 2632092

[51] Int. Cl.[2] ..... B01D 47/00

[52] U.S. Cl. ..... 55/85; 55/89; 55/228; 201/29; 585/840; 585/868

[58] Field of Search ..... 55/68, 70, 73, 85, 88, 55/89, 228; 201/28, 29; 260/674 N

[56] References Cited

U.S. PATENT DOCUMENTS

| | | | |
|---|---|---|---|
| 1,830,178 | 11/1931 | Sperr | 55/85 |
| 1,977,104 | 10/1934 | Agronofsky | 55/85 |
| 3,020,138 | 2/1962 | Wothly | 55/70 |
| 3,784,017 | 1/1974 | Arnold et al. | 55/228 |
| 3,795,486 | 3/1974 | Ekman | 55/228 |

*Primary Examiner*—Bernard Nozick

*Attorney, Agent, or Firm*—Thomas H. Murray; Clifford A. Poff

[57] ABSTRACT

Hot gases containing naphthalene and tar together with the possible inclusion of solids are contacted in a spray tower with water to cool the gases. A naphthalene extraction agent, such as tar, is vigorously admixed with water withdrawn from the spray tower. The admixture is separated in a settling tank from which water is obtained and recycled to the spray tower for cooling further quantities of gases. Solids, gas condensate and tar enriched with naphthalene are separately removed from the settling tank.

7 Claims, 1 Drawing Figure

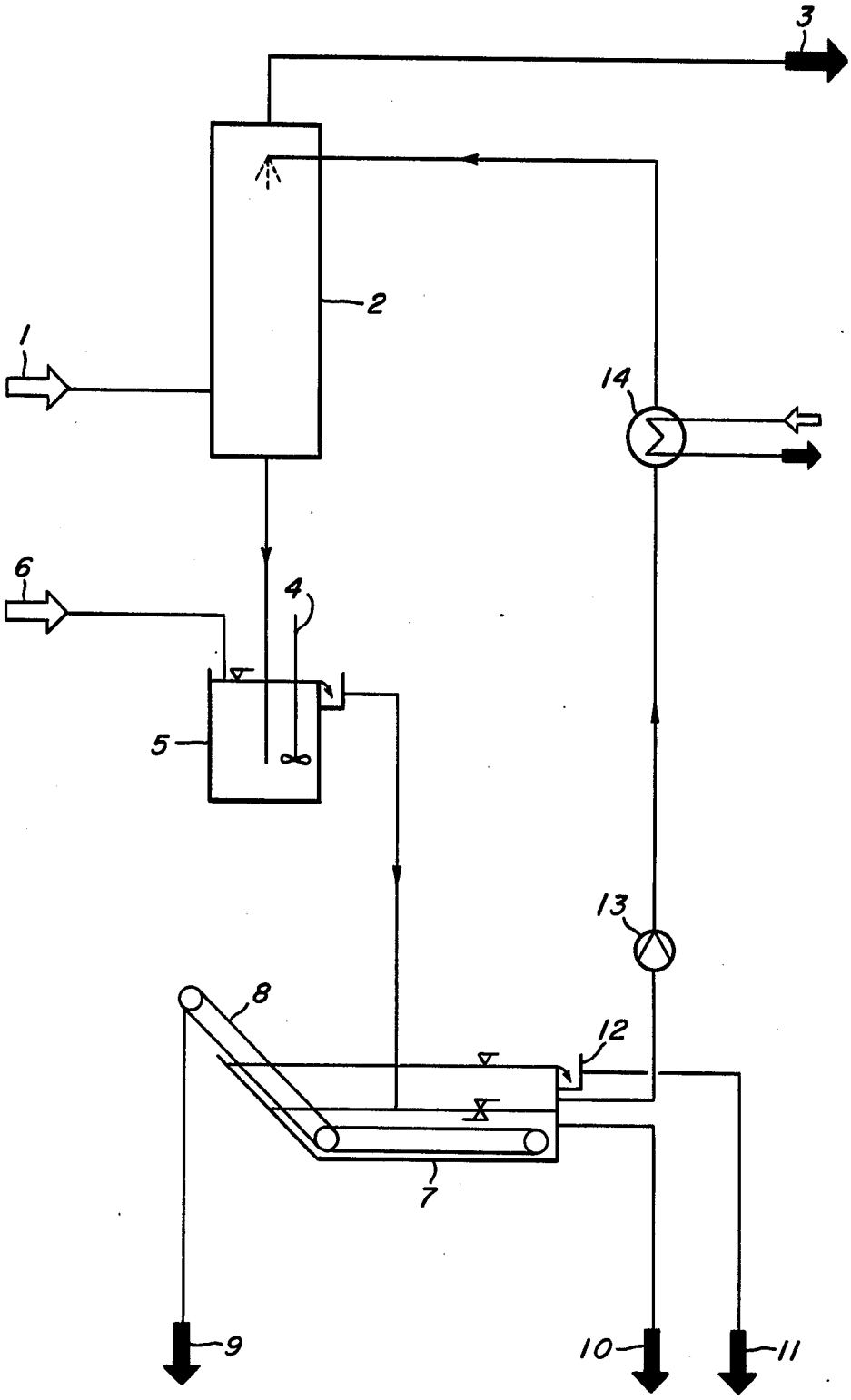
3
2
1
14
6
4
5
13
8
12
7
9
10
11

METHOD FOR COOLING GASES CONTAINING NAPHTHALENE, TAR AND SOLIDS

BACKGROUND OF THE INVENTION

This invention relates to a method of cooling hot gases containing solids, tar and naphthalene wherein the hot gases are treated with a cooling fluid in a direct condenser to cool the gases. More particularly, the present invention relates to such a method wherein the cooling fluid is purified in a circuit for recycling to treat further quantities of gas.

In many gasification and degasification processes, particularly the destructive distillation process occurring during the coking of coal, gases are liberated containing tar and naphthalene. Frequently, the gases also contain solids, such as carbon black and mineral salts. When such gases are cooled in heat exchangers having stationary cooling surfaces, the tar, naphthalene and solids are deposited mainly on the cooling surfaces. These deposits foul and clog the heat exchanger. As a result, the heat exchanger devices must frequently be taken out of operation and cleaned. Usually the heat exchangers are made much larger than necessary to insure long periods of operation.

To avoid the disadvantages of fouling and clogging of the stationary cooling surfaces in heat exchangers, sometimes also referred to in the art as gas condensers, the hot gases are brought into direct contact with a cooling fluid, usuallywater in a direct gas condenser. The cooling fluid contacts the gases without the use of cooling surfaces because they become readily fouled.

Direct gas condensers, as they are usually referred to in the art, operate for relatively long periods of time and do not need to be excessively large in size. Usually, the cooling water which has been heated in the direct gas condenser is collected after traveling through the condenser. The collected cooling water is pumped to one or more circulating condensers where the water is cooled until it can be recycled to the direct gas condenser. However, substances, such as gas condensate, solids, tar and naphthalene, are withdrawn from the gases undergoing cooling and accumulate in the circulating cooling water. The accumulation of such substances interferes with the operation of the circulating condensers and the nozzles used in the direct gas condenser. Consequently, part of the circulating cooling fluid must be continuously withdrawn and purified.

It is another known method in the art to reduce the amount of circulating fluid which has to be washed or purified by using a tar separator in the cooling fluid circuit whereby tar and solids are separated from the circulating water by settling to achieve phase separation. The tar and solids are thus removed from the circuit by the separator. This known method does not eliminate fouling of the circulating condenser. Usually, the circulating condenser is divided into a number of individually-switchable condenser devices or units so that a condenser unit or device can be cleaned without eliminating entirely the circulating condenser function in the circuit.

It is also known to introduce additional quantities of tar into the circuit wherein the tar partially dissolves the naphthalene incrustations in the circulating condensers, thus prolonging the periods of operation by the condensers. However, the practical effect of adding tar to the circuit is limited.

SUMMARY OF THE INVENTION

It is an object of the present invention to provide a method for cooling gases to improve the reliability of operation in a direct gas cooling and prolonging the operating periods by individual parts forming a cooling system without the requirement that the parts be constructed excessively large in size.

It is a further object of the present invention to provide a method for cooling gases containing inter alia naphthalene with a cooling fluid without fouling circulating condensers or coolers for the cooling fluid based on the realization that when the cooling fluid cools, the solubility limit for naphthalene is exceeded and consequently deposits of solid naphthalene will occur on cooling surfaces.

More particularly, according to the present invention, there is provided a method for cooling gases which includes inter alia naphthalene, wherein a cooling fluid leaving a direct contact condenser is vigorously mixed with a naphthalene extracting agent and the extracting agent laden with naphthalene is separated from the circulating fluid by settling before the fluid is recycled to the circulating condenser. Preferably, the circulating fluid is water and the naphthalene extraction agent is tar obtained from a tar separation process in a subsidiary recovery plant.

More specifically, according to the present invention there is provided a mehtod for cooling gases containing naphthalene and tar together with the possible inclusion of solids, the method including the steps of contacting the gases in a direct condenser with a circulating cooling fluid to cool the gases, vigorously admixing a naphthalene extraction agent with cooling fluid withdrawn from the direct condenser, separating naphthalene extracted from the cooling fluid by settling, and returning the cooling fluid obtained by the separation into the direct condenser to cool further quantities of gases.

In the method of the present invention, the extraction of naphthalene is carried out through the use of a mixer and a settling tank, the mixer being a vessel having an agitator and an overflow. The settling tank is a tar separator in which tar is separated as one phase and solids which are washed out of the treated gases are simultaneously settled out and removed as a solid phase.

These features and advantages of the present invention as well as others will be more fully understood when the following description is read in light of the accompanying drawing which is a schematic illustration of one arrangement of apparatus to carry out the process of the present invention.

The schematic illustration in the drawing represents a plant for precooling of gases obtained from coke ovens. Hot gases at a temperature of approximately 80° C. flow through line 1 into the bottom of a direct gas condenser 2 such as a spray tower. The gases flow upwardly in the condenser in a countercurrent manner to cooling fluid such as water which is injected into the top of the tower by nozzles or the like. The gases are conducted from the condenser by line 3 at an outlet temperature of approximately 30° C. In the spray tower type condenser, the injected water is heated to a temperature of about 60° C. and simultaneously absorbs naphthalene, tar and solids from the gases. Cooling water withdrawn from the spray tower is fed into a mixer 5 having an agitator 4 which is driven in a suitable manner, such as by a drive motor.

A naphthalene extraction agent, such as tar, from a tar separator apparatus, not shown, is supplied through line 6 into the mixer 5. In the mixer, the cooling water is vigorously mixed with the tar by the agitator, In the mixing process, the tar absorbs most of the entrained naphthalene from the cooling water. The mixture, after vigorous admixing, is fed from the mixer 5 through a suitable outlet, such as an overflow, into a settling tank 7. In the settling tank, the tar is separated from the cooling water and solids simultaneously settle out of the mixture. A discharge device 8, such as a conveyor, mechanically removes the solids from the settling tank. The solids are discharged through line 9. The tar separation phase enriched with naphthalene is discharged from the settling tank through line 10. Excess gas condensate is discharged from the settling tank and the circuit by line 11 from an overflow 12. The cooling water which is now free from tar, solids and naphthalene, is conveyed by a pump 13 to a saturation condenser 14 wherein the water is cooled by a cooling agent such as water to 25° C which is the required temperature for cooling the gases in the direct gas condenser 2. The cooling water is then returned by line 15 to the direct gas condenser 2. Usually, the amount of circulating cooling water required for direct precooling of coke oven gas is approximately 0.010 to 0.013 $m^3/Nm^3$ of coke oven gases. In the examplified embodiment of the present invention, the amount of tar required to form the naphthalene extraction agent is approximately 1 to $5\times10^{-}m^3/Nm^3$of gases.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A method for cooling gases containing naphthalene and tar together with the possible inclusion of solids, said method including the steps of:

contacting the gases in a direct condenser with a cooling liquid to cool the gases and to remove naphthalene from the gases, withdrawing cooling liquid from the direct condenser into a separate mixer after contact with the gases, vigorously admixing the withdrawn cooling liquid containing naphthalene with a naphthalene extraction agent unenriched with naphthalene introduced into said mixer having a driven agitator to extract naphthalene from the cooling liquid, feeding the vigorously admixed naphthalene extraction agent and cooling liquid from the mixer into a settling tank, separating the cooling liquid in said settling tank by settling out of the naphthalene extraction agent while enriched with the naphthalene extracted from the cooling liquid, withdrawing cooling liquid from the upper part of the settling tank, withdrawing the naphthalene extraction agent from the lower part of the settling tank, removing solids from the settling tank, and returning the withdrawn cooling liquid obtained by said step of separating into said direct condenser to cool further quantities of gases by said step of contacting.

2. The method according to claim 1 wherein said direct condenser is a spray tower.

3. The method according to claim 1 including the further step of withdrawing the naphthalene extraction agent enriched with naphthalene from said settling tank, withdrawing solids from said settling tank, and withdrawing gas condensate from said settling tank.

4. The method according to claim 1 wherein said step of returning the cooling fluid includes cooling the cooling fluid.

5. The method according to claim 1 wherein said circulating cooling liquid is water, and said naphthalene extraction agent is tar.

6. The method according to claim 5 including the furher step of feeding tar obtained from a subsidiary tar recovery separator for said step of vigorously admixing.

7. The method according to claim 6 wherein said gases include distillation gases from a coke oven.

* * * * *